US005909954A

United States Patent [19]

Thomas

[11] Patent Number: 5,909,954

[45] Date of Patent: Jun. 8, 1999

[54] REFLECTIVE SHADE FOR ELECTRIC TABLE LAMP

[76] Inventor: Stephen E. Thomas, 38840 Godfrey Pl., Fremont, Calif. 94536

[21] Appl. No.: 08/871,392

[22] Filed: Jun. 9, 1997

[51] Int. Cl.[6] ..... F21V 7/00

[52] U.S. Cl. ..... 362/307; 362/313; 362/314; 362/350; 362/351; 362/441; 362/311; 362/293; 362/355; 362/356; 362/363

[58] Field of Search ..... 362/307, 313, 362/314, 350, 351, 441, 311, 293, 355, 356, 363

[56] References Cited

U.S. PATENT DOCUMENTS 4,001,576 1/1977 Goddard ..... 240/108
4,063,079 12/1977 Feder ..... 362/290
4,667,278 5/1987 Foyer ..... 362/267
5,209,561 5/1993 Bond ..... 362/163
5,513,084 4/1996 Simpson ..... 362/284

*Primary Examiner*—Sandra O'Shea
*Assistant Examiner*—John A. Ward
*Attorney, Agent, or Firm*—Linval B. Castle

[57] ABSTRACT

A reflective shade for an electric table lamp includes a conventional frustrum shape but with removeable translucent plastic disks spanning the top opening for reflecting the light back down toward the table top and for transmitting colored light for creating an ambiance in the environment. The disks attached to the shade are supported on a cylindrical chimney and the lower disk may fit within the chimney to center the shade on the lamp.

8 Claims, 2 Drawing Sheets

REFLECTIVE SHADE FOR ELECTRIC TABLE LAMP

This invention relates to lamps and particularly to a lamp configuration which utilizes the space now used for supplying air and for exhausting heat from open flame lamps to effect an improved ambiance of the lamp's decor.

BRIEF SUMMARY OF THE INVENTION

Portable cordless table lamps that utilize electric power as an energy source in lieu of fossil burning fuel are becoming quite popular in many areas of the marketplace such as restaurants, yachts, cruise ships, retirement homes, recreational vehicles, patios, swimming pools, etc. Particularly, lamps such as the long burning, rechargeable battery type of lamp described in U.S. Pat. No. 4,764,853.

Most portable and cordless table lamps have been design to accommodate open flame type lighting which means they must have an air passage to support combustion as well as to exhaust the heat fro open flame. The air passage requires a heat zone directly above the flame to be vacated. The electric rechargeable battery portable lamps as reference above requires no such restrictions and thereby lend themselves to broader lamp design innovations.

The mistique of a flickering candle on a dining table has always been thought of as producing the essence of ambiance. Times change and that which was thought to be an essence of ambiance is now recognized as an air polluter having by-products of burnt fossil fuel which represent hazards to health as well as a fire hazard.

This invention is not limited to applications with low voltage filament bulbs but could also be used with any light source with low heat output, i.e. low wattage incandescent bulbs, LED arrays, fluorescent, etc.

The lamp shade for the lamp is a conventional frustum shape with a transparent of translucent plastic disk system overlying the lamp bulb for reflecting downward to the table surface a portion of the light that normally passes through the top opening of the shade. A portion of this disk system, having a diameter slightly smaller that the chimney diameter, also acts as a centering device for the lamp shade in mounted position. This disk system can have multiple combinations of disks which would create a color wheel effect, yielding different lighting effects, varying color as well as reflecting light to the table top surface.

For example, a simple disk system would be comprised of two disks. Overlying the disk in the lamp chimney is a second transparent or translucent plastic disk or larger diameter. This second disk (top disk) is back lighted by the first disk (bottom disk) such that refracted light may be subdued to create a soft white or colored surface rather than a gaping hole with visible lamp support members. This second disk also reflects light down to the table top surface and can be used in a color mix wheel effect, as stated above, to arrive at a variety of color decors.

The disks may be glued to the support metal in the lampshade as a permanent installation, or disks may be easily removable to allow the used to vary the color pattern for any number of reasons, e.g. Holiday colors, seasonal color pattern with top disk having a message, change the basic color decor of a room, etc. There are a number or ways to allow simple removal and change of disks such as screw, standard plastic pop-on and -off, small permanent magnet mounted either to lamp shade support member and disk having magnetic sensitive washer cemented to the disks or vice versa etc. Discussions with restaurant people indicate a desire for color change capability.

BRIEF DESCRIPTION OF THE DRAWING

In the drawings that illustrate the preferred embodiment of the invention.

DETAILED DESCRIPTION OF THE PREFERRED EMBODIMENT

Figure 1:
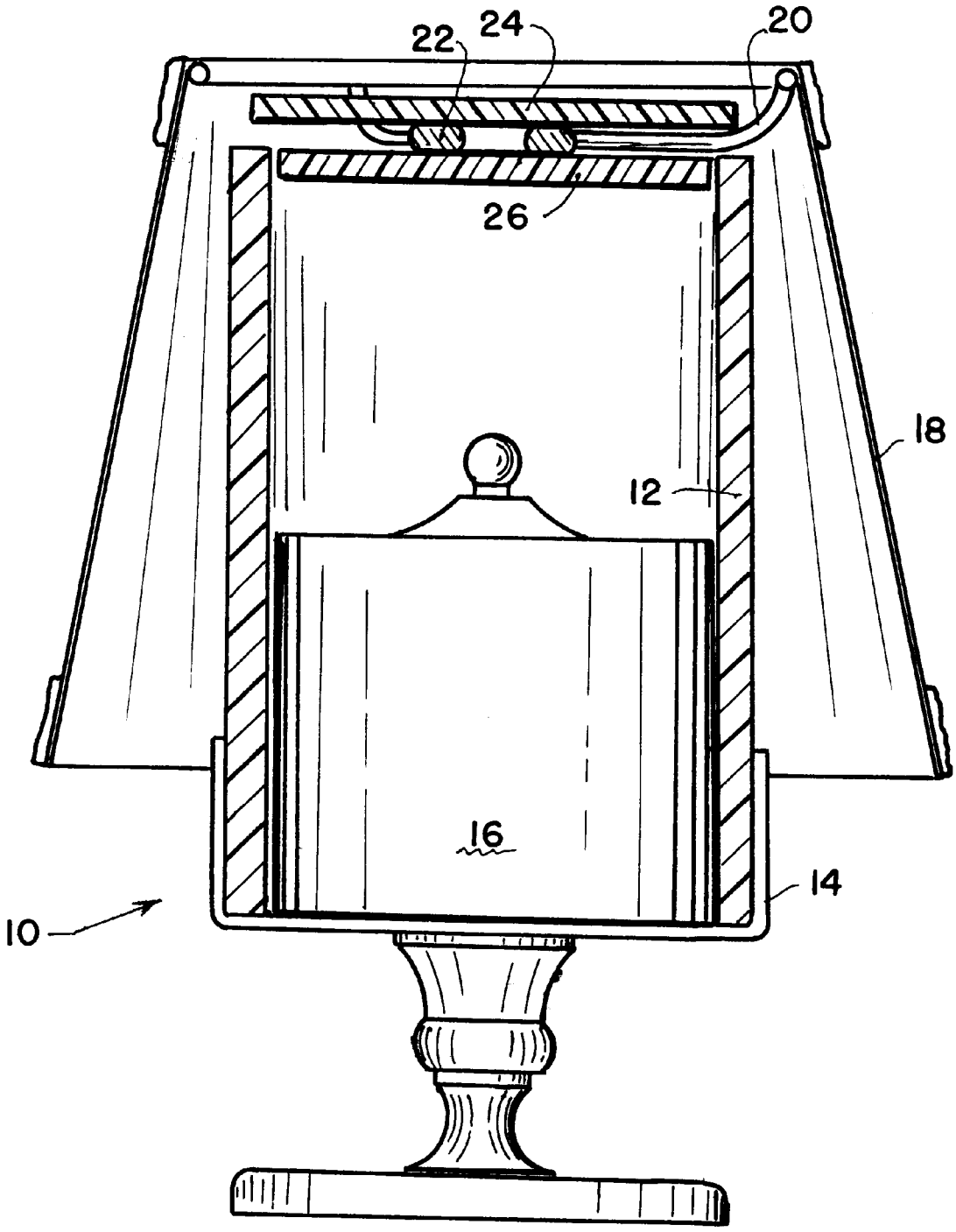
FIG. 1 is a sectional elevational view of an electric lamp with the reflective lamp shade.

The reflective lamp shade is usable with any type of electric lamp, such as the battery operated lamp described in U.S. Pat. No. 4,764,853 that can operate for many hours before needing recharging. As shown in FIG. 1, the lamp 10 is equipped with a long tubular, frosted, plastic chimney 12 which fits upon an ornamental base 14 supporting the lamp housing 16. The lamp shade 18 rests on the top surface of the chimney 12.

Figure 2:
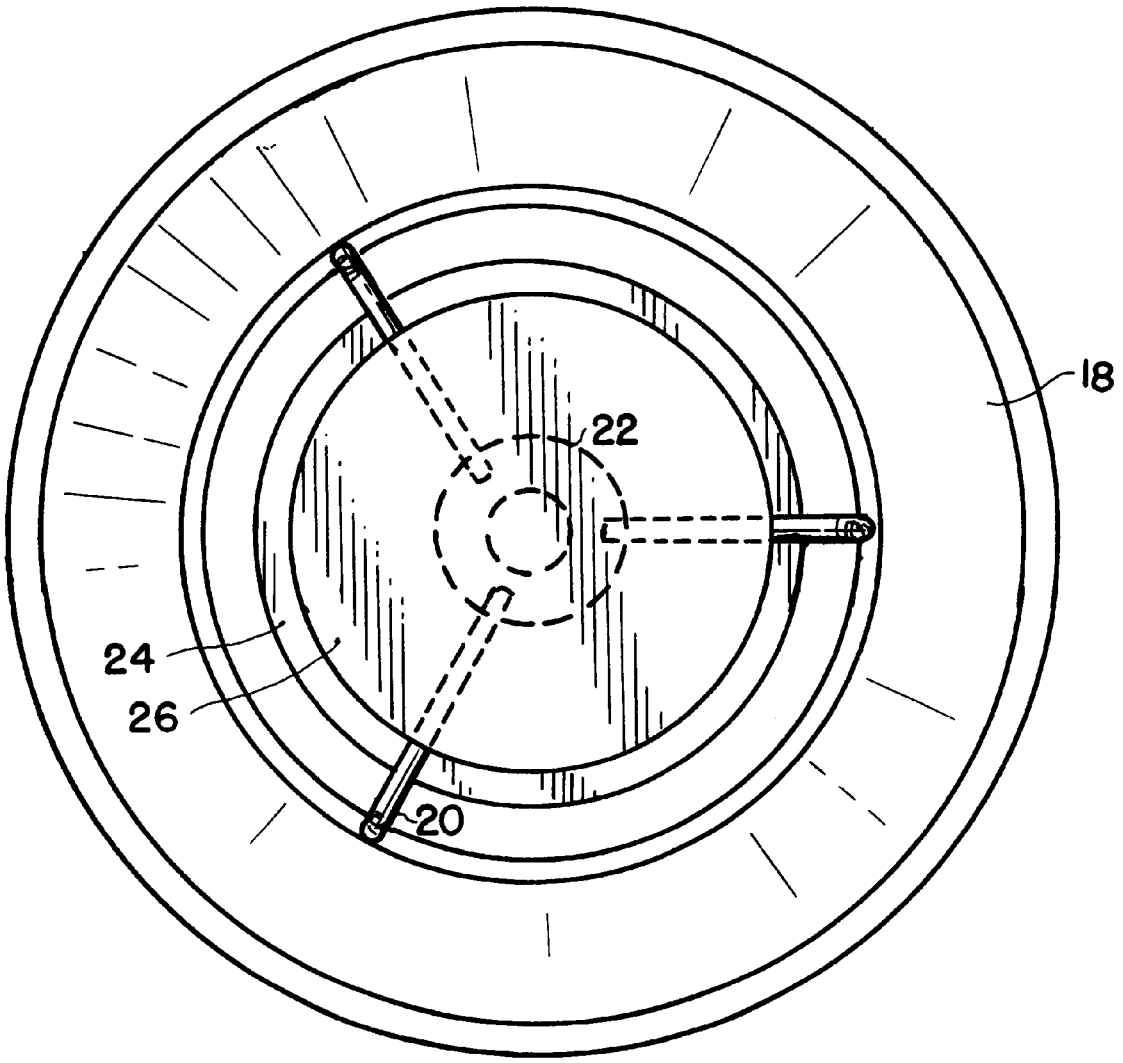
FIG. 2 is a bottom plan view of the reflective lamp shade.

Lamp shade 18 is a conventional lamp shade with a translucent cloth, plastic or paper frustum shape exterior that is supported by a wire frame 20, three or four of which are inwardly bent and attached to a central toroidal ring 22 at the top of the shade, as shown in FIG. 2, for attachment of the shade to the top of a harp around the bulb on a conventional lamp.

To increase the illumination upon the stand or table upon which the lamp is placed, the lamp shade is modified by securing a translucent or transparent disk 26 to the bottom surface of the toroidal ring 22 so that the reflective interface surface is facing down toward the light source. This disk 26 should have a diameter slightly less than the inside diameter of the tubular chimney 12 and functions both to reflect light down from its surfaces toward the light source and to center the shade on the chimney 12. The illumination upon a table top has been increased by as much as 30% by the addition of the reflective disk 26.

A second plastic disk 24 is secured to the top surface of the toroidal ring 22. The disk may be permanently secured by cementing the disk to the ring or, if desired, may be secured by boring a small hole through the centers of both the disk 26 and disk 24 and attaching both the disks to the toroidal ring 22 with a machine screw. Second disk 24 has a diameter greater that the outside diameter of the chimney 12 to intercept a maximum amount of light that passes through the central to opening of the shade. Light is also reflected from the surfaces of disk 24.

The second disk 24 is preferably translucent, but a very pleasing effect is achieved if at least the second disk 24 is of a colored plastic. Alternately, it is practical to overlay various colored plastic disks to disk 24. Some very interesting hues are achieved by using a second translucent red colored plastic disk 24 with a blue plastic overlay, or with a blue translucent disk 26 if a very light shade of blue is desired on the table top.

I claim:

1. A lamp shade for an electric lamp having an vertical, translucent, ornamental chimney surrounding the lamp bulb, said chimney having a tubular top surface with an inside and an outside diameter; said lamp shade comprising:

a frame supporting a frustum shaped lamp shade, said frame including a toroidal mounting ring having a common central axis with said lamp shade, said ring having a top and a bottom surface;

a first translucent disk secured to the top surface of said toroidal ring, said first disk having a diameter greater than the inside diameter but no greater than the outside diameter of said top surface of said tubular chimney; and a second translucent disk secured to the bottom surface of said toroidal ring, said second disk having a diameter slightly less than the inside diameter of said top surface of said tubular chimney.

2. The lamp shade claimed in claim 1 wherein said first translucent disk is colored.

3. The lamp shade claimed in claim 1 wherein said second translucent disk is colored.

4. The lamp shade claimed in claim 2 wherein said first translucent disk is colored.

5. In a lamp shade for an electric lamp having a vertical, translucent, tubular ornamental chimney surrounding the lamp bulb, said lamp shade having a toroidal mounting ring with a top and a bottom surface, said ring being centered near the top of said shade, reflecting means for reflecting light downward, said reflecting means comprising:

a first translucent disk secured to the top surface of said toroidal mounting ring, said first disk having a diameter greater than the diameter of said tubular chimney; and a second translucent disk secured to the bottom surface of said toroidal mounting ring, said second disk having a diameter slightly less than the inside diameter of said tubular chimney.

6. The lamp shade claimed in claim 5 wherein said relecting means for reflecting the light downward also functions to center the lamp shade.

7. The lamp shade claimed in claim 5 wherein said first and second disks are colored plastic.

8. The lamp shade claimed in claim 7 wherein said disks may be easily changed to alter the color combinations to change the ambiance of the environment.

* * * * *